US008038259B2

(12) United States Patent
Sakaida et al.

(10) Patent No.: US 8,038,259 B2
(45) Date of Patent: Oct. 18, 2011

(54) INK-JET RECORDING APPARATUS

(75) Inventors: Atsuo Sakaida, Nagoya (JP); Atsushi Hirota, Nagoya (JP); Naoto Iwao, Nagoya (JP); Tatsuo Oishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 367 days.

(21) Appl. No.: 12/022,316

(22) Filed: Jan. 30, 2008

(65) Prior Publication Data

US 2008/0284807 A1 Nov. 20, 2008

(30) Foreign Application Priority Data

Jan. 30, 2007 (JP) ..... 2007-019704

(51) Int. Cl.
*B41J 2/15* (2006.01)

(52) U.S. Cl. ..... 347/40; 347/5; 347/9; 347/12; 347/13; 347/20; 347/42

(58) Field of Classification Search ..... None
See application file for complete search history.

(56) References Cited

U.S. PATENT DOCUMENTS

| | | | | |
|---|---|---|---|---|
| 5,946,011 | A * | 8/1999 | Kanaya | 347/41 |
| 6,046,819 | A * | 4/2000 | Yoshida | 358/1.8 |
| 6,302,517 | B1 * | 10/2001 | Kanaya | 347/41 |
| 6,443,554 | B1 * | 9/2002 | Yoshida | 347/41 |
| 6,533,379 | B1 * | 3/2003 | Kubota | 347/12 |
| 2002/0196304 | A1 * | 12/2002 | Gomez et al. | 347/23 |
| 2004/0028421 | A1 * | 2/2004 | Shiratori | 399/49 |
| 2004/0051747 | A1 * | 3/2004 | Nunokawa et al. | 347/5 |
| 2004/0156666 | A1 * | 8/2004 | Ouchi et al. | 400/708 |
| 2005/0122376 | A1 * | 6/2005 | Oishi | 347/40 |
| 2005/0190216 | A1 * | 9/2005 | Yamazaki et al. | 347/6 |
| 2005/0259128 | A1 | 11/2005 | Kusunoki | |
| 2006/0012631 | A1 * | 1/2006 | Niekawa | 347/41 |
| 2006/0028500 | A1 | 2/2006 | Sakaida et al. | |
| 2006/0028507 | A1 | 2/2006 | Sakaida et al. | |
| 2006/0050101 | A1 | 3/2006 | Sakaida | |
| 2008/0018710 | A1 * | 1/2008 | Mantell | 347/63 |

FOREIGN PATENT DOCUMENTS

EP 0914948 A2 5/1999

(Continued)

OTHER PUBLICATIONS

European Patent Office, European Search Report issued in counterpart Patent Application No. EP 08001633, mailed Jul. 6, 2009.

(Continued)

*Primary Examiner* — Matthew Luu
*Assistant Examiner* — Justin Seo
(74) *Attorney, Agent, or Firm* — Baker Botts L.L.P.

(57) ABSTRACT

An ink-jet recording apparatus of one aspect of the invention comprises nozzles are arranged on an ink ejection surface in a matrix in a first direction in which a recording medium is conveyed and a second direction orthogonal to the first direction. The plurality of nozzles are grouped into a plurality of nozzle sets, each of the plurality of nozzle sets includes nozzles arranged along the second direction. The plurality of nozzle sets are spaced from one another in the first direction by first distances, each of the first distances is an integral multiple of a distance that is obtained by multiplying a unit distance by $2^{n-1}$. The unit distance corresponds to a highest resolution among first resolutions with respect to the first direction of an image to be formed on the recording medium.

22 Claims, 8 Drawing Sheets

FOREIGN PATENT DOCUMENTS

| | | | |
|---|---|---|---|
| EP | 1361070 | A1 | 11/2003 |
| JP | H09-136409 | A | 5/1997 |
| JP | 2000-025207 | A | 1/2000 |
| JP | 2006044113 | A | 2/2006 |
| JP | 2006-281776 | A | 10/2006 |

OTHER PUBLICATIONS

Japan Office Action, Office Action in Japanese Patent Application No. 2007-019704 (counterpart to the above-captioned U.S. Patent Application) mailed Jan. 27, 2009. (partial translation).

* cited by examiner

INK-JET RECORDING APPARATUS

CROSS-REFERENCE TO RELATED APPLICATIONS

This application is based upon and claims the benefit of priority from Japanese Patent Application No. 2007-019704, filed on Jan. 30, 2007, the entire contents of which are incorporated herein by reference.

TECHNICAL FIELD

The present invention relates to an ink-jet recording apparatus that forms an image on a recording medium.

BACKGROUND

As ink-jet printers that eject ink droplets to a recording medium, such as a recording sheet, an ink-jet printer including a conveying mechanism that conveys a recording sheet, and an ink-jet head having an ink ejection surface in which a number of nozzles that eject ink droplets to the recording sheet conveyed by the conveying mechanism are disposed is known. A number of individual ink channels that lead from an outlet of a common ink chamber through pressure chambers to the nozzles are formed inside the ink-jet head. Further, the ink-jet head has an actuator that individually applies ejection energy to the ink within each pressure chamber according to an instruction from a control device. As such an ink-jet head, there is an ink-jet head in which a number of nozzles are disposed in a matrix in a conveying direction of a recording sheet, and in a direction orthogonal to the conveying direction in the ink ejection surface in order to enhance the density of ejection channels of ink droplets. Such ink-jet printer is disclosed in, for example, JP-A-2006-044113.

According to the above ink-jet printer, only from a viewpoint of the enhancement of the density of ejection channels of ink droplets, a number of nozzles are disposed in a matrix in the ink ejection surface. Therefore, the positions of the nozzles in the conveying direction of a recording sheet are determined regardless of the control period of the control device for ink ejection. For this reason, for example, when the resolution of a printing image in the conveying direction of a recording sheet is changed, the control period and the timing with which an ink droplets are ejected to positions on the recording sheet where dots are to be formed may not coincide with each other. In this case, the positions of dots to be formed on the recording sheet in the conveying direction of the recording sheet vary, and thereby printing quality deteriorates. In order to solve this problem, it is considered that the control period of the control device is further shortened. However, it is necessary to further improve the processing speed of the control device in shortening the control period, and consequently, the cost of the control device becomes high.

SUMMARY

Thus, an object of aspects of the invention is to provide an ink-jet recording apparatus capable of keeping printing quality from deteriorating and preventing the cost of a control device from becoming high, even in a case where resolution in the conveying direction of a recording medium changes.

According to an aspect of the invention, there is provided an ink-jet recording apparatus comprising: a conveying unit configured to convey a recording medium; an ink-jet head including an ink ejection surface having a plurality of nozzles formed thereon configured to eject ink to the recording medium conveyed by the conveying unit in a first direction; a storage unit configured to store a plurality of first resolutions with respect to the first direction of an image to be formed on the recording medium, a number of the first resolutions defined as n ($n \geqq 2$); a resolution designation unit configured to designate one of the first resolutions stored in the storage unit; and a head control unit configured to control driving of the ink-jet head according to the designated first resolution, wherein the plurality of nozzles are arranged on the ink ejection surface in a matrix in the first direction and in a second direction orthogonal to the first direction, wherein the plurality of nozzles are grouped into a plurality of nozzle sets, each of the plurality of nozzle sets including nozzles arranged along the second direction, and wherein the plurality of nozzle sets are spaced from one another in the first direction by first distances, each of the first distances is an integral multiple of a distance that is obtained by multiplying a unit distance, corresponding to a highest resolution among the first resolutions stored in the storage unit, by $2^{n-1}$.

DESCRIPTION

Hereinafter, illustrative, non-limiting embodiments of the invention will be described with reference to the drawings.

Figure 1:
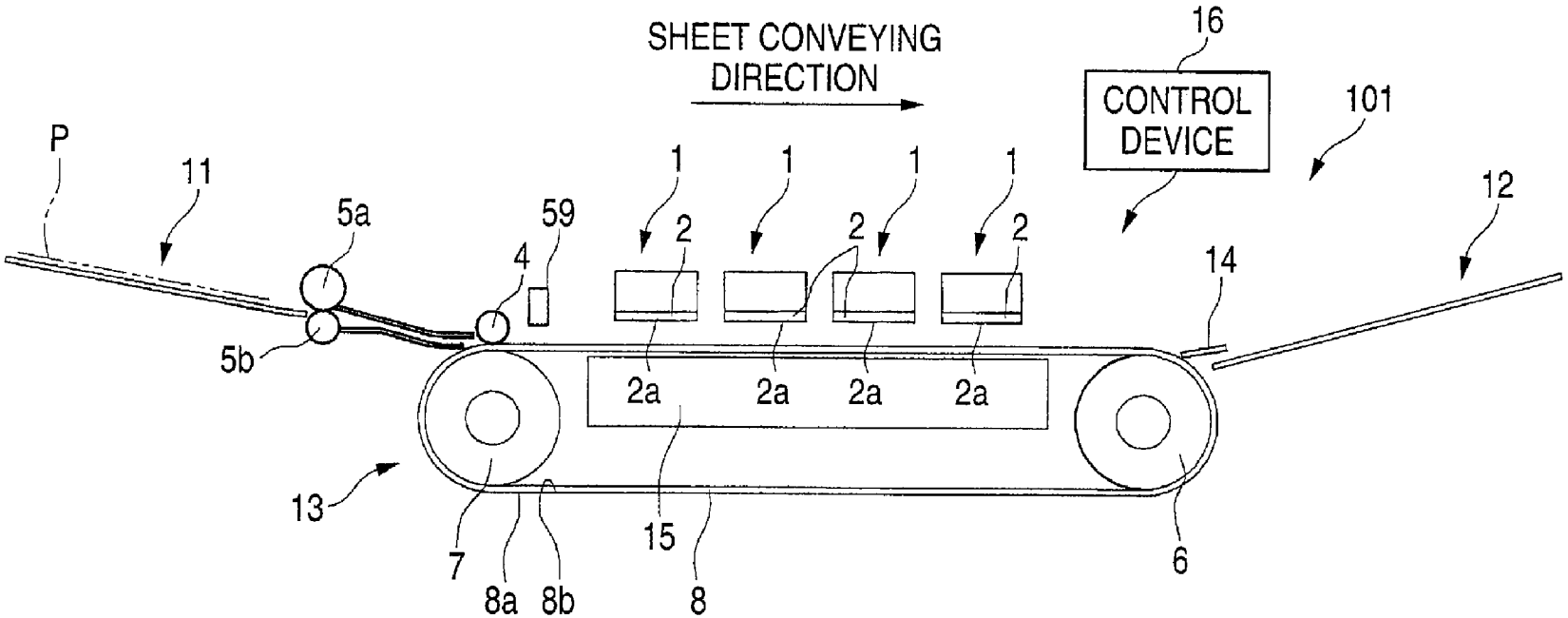
FIG. 1 is an appearance side view of an ink-jet head according to an embodiment of the invention.

FIG. 1 is a schematic side view showing the overall configuration of an ink-jet printer that is an embodiment according to the invention. As shown in FIG. 1, an ink-jet printer 101 is a color ink-jet printer that has four ink-jet heads 1. Further, the ink-jet printer 101 has a control device 16 that controls the whole operation of the ink-jet printer 101. In this ink-jet printer 101, a sheet feed unit 11 is provided on the left in the drawing, and a sheet discharge unit 12 is provided on the right in the drawing.

A sheet conveying path along which a sheet (recording medium) P is conveyed toward the sheet discharge unit 12 from the sheet feed unit 11 is formed inside the ink-jet printer 101. A pair of feed rollers 5*a* and 5*b* that nip and convey a sheet are disposed immediately downstream of the sheet feed unit 11. The pair of feed rollers 5*a* and 5*b* are provided to deliver a sheet P to the right in the drawing from the sheet feed unit 11. An intermediate portion of the sheet conveying path is provided with a belt conveyor mechanism (as an example of a conveying unit) 13 including two belt rollers 6 and 7, an endless conveyor belt 8 that is wound so as to be laid between both the rollers 6 and 7, and a platen 15 that is disposed in a position that faces the ink-jet heads 1 in a region surrounded by the conveyor belt 8. The platen 15 supports the conveyor belt 8 so that the conveyor belt 8 may not be flexed downward in the region that faces the ink-jet heads 1. A nip roller 4 is disposed in a position that faces the belt roller 7. The nip roller 4 presses a sheet P that is delivered by the feed rollers 5*a* and 5*b* from the sheet teed unit 11, against an outer peripheral surface 8*a* of the conveyor belt 8.

As a conveying motor that is not shown rotates the belt roller 6, the conveyor belt 8 is driven. Thereby, the conveyor belt 8 conveys a sheet P pressed against the outer peripheral surface 8*a* by the nip roller 4 toward the sheet discharge unit 12 while adhesively holding the sheet.

A separating mechanism 14 is provided immediately downstream of the conveyor belt 8 along the sheet conveying path. The separating mechanism 14 is configured so as to separate a sheet P, which is adhered to the outer peripheral surface 8*a* of the conveyor belt 8, from the outer peripheral surface 8*a*, to feed the sheet toward the sheet discharge unit 12 on the right in the drawing.

The four ink-jet heads 1 are arranged along the conveying direction in correspondence with four kinds of color inks (magenta, yellow, cyan, and black). That is, this ink-jet printer 101 is a line type printer. Each of the four ink-jet heads 1 has a head body 2 at its lower end. The head body 2 is formed in the shape of a slender rectangular parallelepiped that is relatively long in a direction orthogonal to the conveying direction. Further, the bottom surface of the head body 2 is an ink ejection surface 2*a* that faces the outer peripheral surface 8*a*. When a sheet P conveyed by the conveyor belt 8 passes through the portions immediately below the four head bodies 2 in order, each color ink is ejected toward the top surface, i.e., printing surface of the sheet P from the ink ejection surface 2*a* so that a desired color image can be formed on the printing surface of the sheet P.

Figure 2:
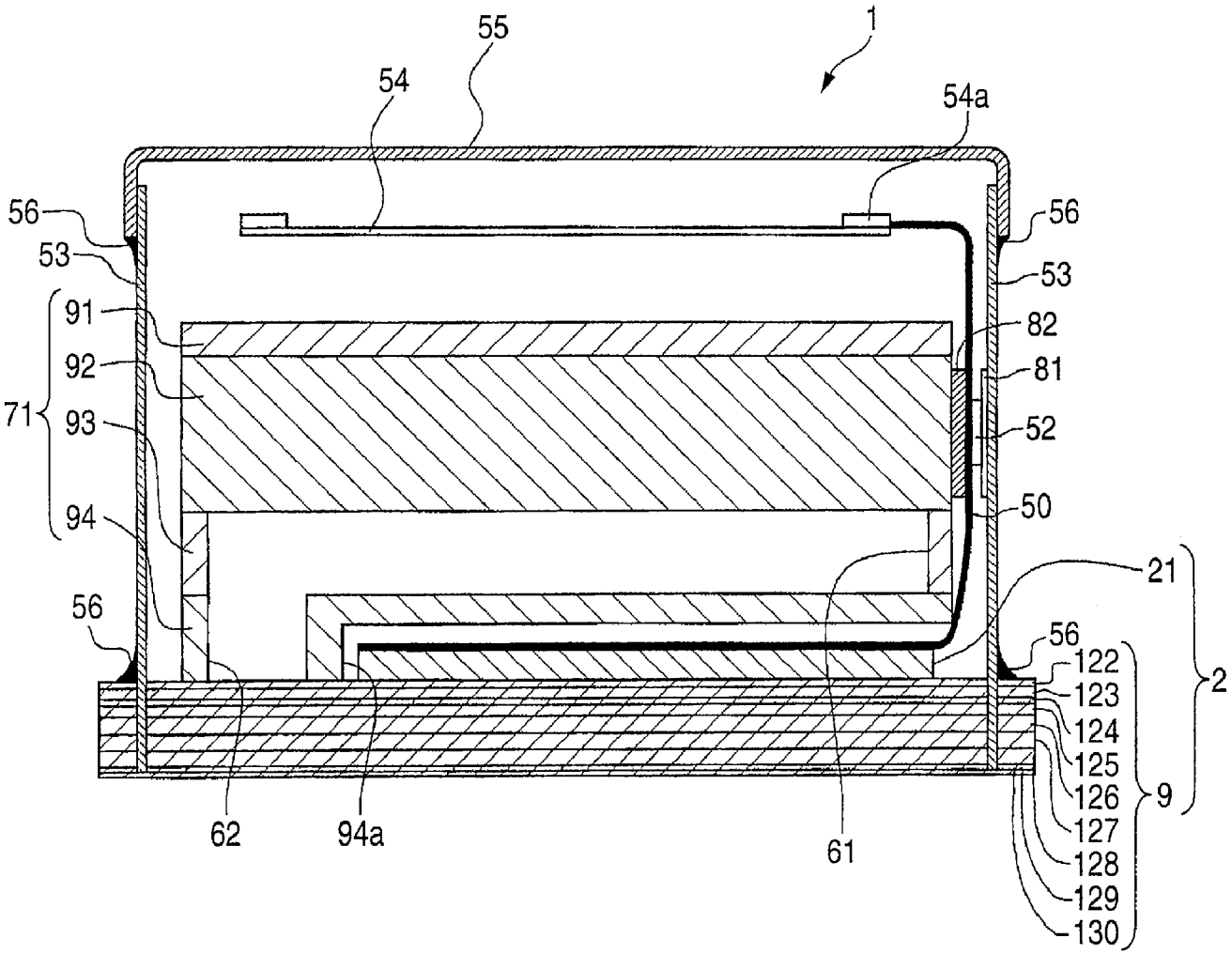
FIG. 2 is a cross-sectional view of the ink-jet head shown in FIG. 1 along its lateral direction.

Next, one ink-jet head 1 will be described in detail referring to FIG. 2. FIG. 2 is a cross-sectional view of the ink-jet head 1 along its lateral direction. As shown in FIG. 2, the ink-jet head 1 has a head body 2 including a channel unit 9 and actuator units 21, a reservoir unit 71 that is disposed on the top surface of the head body 2 to supply ink to the head body 2, a COF (Chip On Film) 50 on the surface of which a driver IC 52 that generates a driving signal that drives the actuator units 21 is mounted, aboard 54 that is electrically connected to the COF 50, and a side cover 53 and a head cover 55 that cover the actuator units 21, the reservoir unit 71, the COF 50, and the board 54 to protect ink or ink mist from intruding into the head from the outside.

The reservoir unit 71 is formed by registering and laminating four plates 91 to 94 on each other, and an ink inflow channel that is not shown, an ink reservoir 61, and ten ink outflow channels 62 are formed inside the reservoir unit so as to communicate with one another. In addition, only one ink outflow channel 62 is shown in FIG. 2. The ink inflow channel allows ink to flow into ink reservoir therethrough from an ink tank that is not shown. The ink reservoir 61 communicates with the ink inflow channel and the ink outflow channels 62, and reserves ink temporarily. The ink outflow channels 62 communicate with the channel unit 9 via ink supply ports 105*b* (refer to FIG. 3) formed in the top surface of the channel unit 9. The ink from the ink tank flows into the ink reservoir 61 via the ink inflow channel. The ink that has flowed into the ink reservoir 61 passes through the ink outflow channels 62, and is supplied to the channel unit 9 via the ink supply ports 105*b*.

Further, a recessed portion 94*a* is formed in the plate 94. In the portion in which the recessed portion 94*a* of the plate 94 is formed, a space is formed between the plate and the channel unit 9, and the actuator units 21 are disposed in the space.

The portion of the COF 50 near its one end is bonded to the top surfaces of the actuator units 21 so that wiring lines (not shown) that are formed on the surface of the COF are electrically connected to individual electrodes 135 and a common electrode 134 to be described later. Moreover, the COF 50 is drawn out upward so as to pass between the side cover 53 and the reservoir unit 71 from the top surfaces of the actuator units 21, and the other end of the COF is connected to the board 54 via a connector 54*a*. At this time, the driver IC 52 of the COF 50 is biased against the side cover 53 by a sponge 82 pasted on the side surface of the reservoir unit 71. The driver IC 52 is thermally combined with the side cover 53 by adhering tightly to the internal surfaces of the side cover 53 with a radiation sheet 81 therebetween. This allows the heat from the driver IC 52 to be radiated to the outside via the side cover 53.

The board 54 outputs a driving signal to the actuator units 21 via the COF 50 on the basis of an instruction from the control device 16, to thereby control driving of the actuator units 21.

The side cover 53 is a metallic plate member that is attached so as to extend upward from near both lateral ends in the top surface of the channel unit 9. The side cover 53 has a plurality of protruding portions that protrude downward, and are erected as the protruding portions fit into corresponding fitting holes of the channel unit 9. The head cover 55 is attached above the side cover 53 so as to seal a space above the channel unit 9. As such, the reservoir unit 71, the COF 50, and the board 54 are disposed in a space surrounded by the two side covers 53 and the head cover 55. A sealing member 56 made of a silicon resin material, etc. is coated on a connecting portion between the side covers 53 and the channel unit 9 and a fitting portion between the side cover 53 and the head cover 55. This more reliably prevents intrusion of ink or ink mist from the outside.

Figure 3:
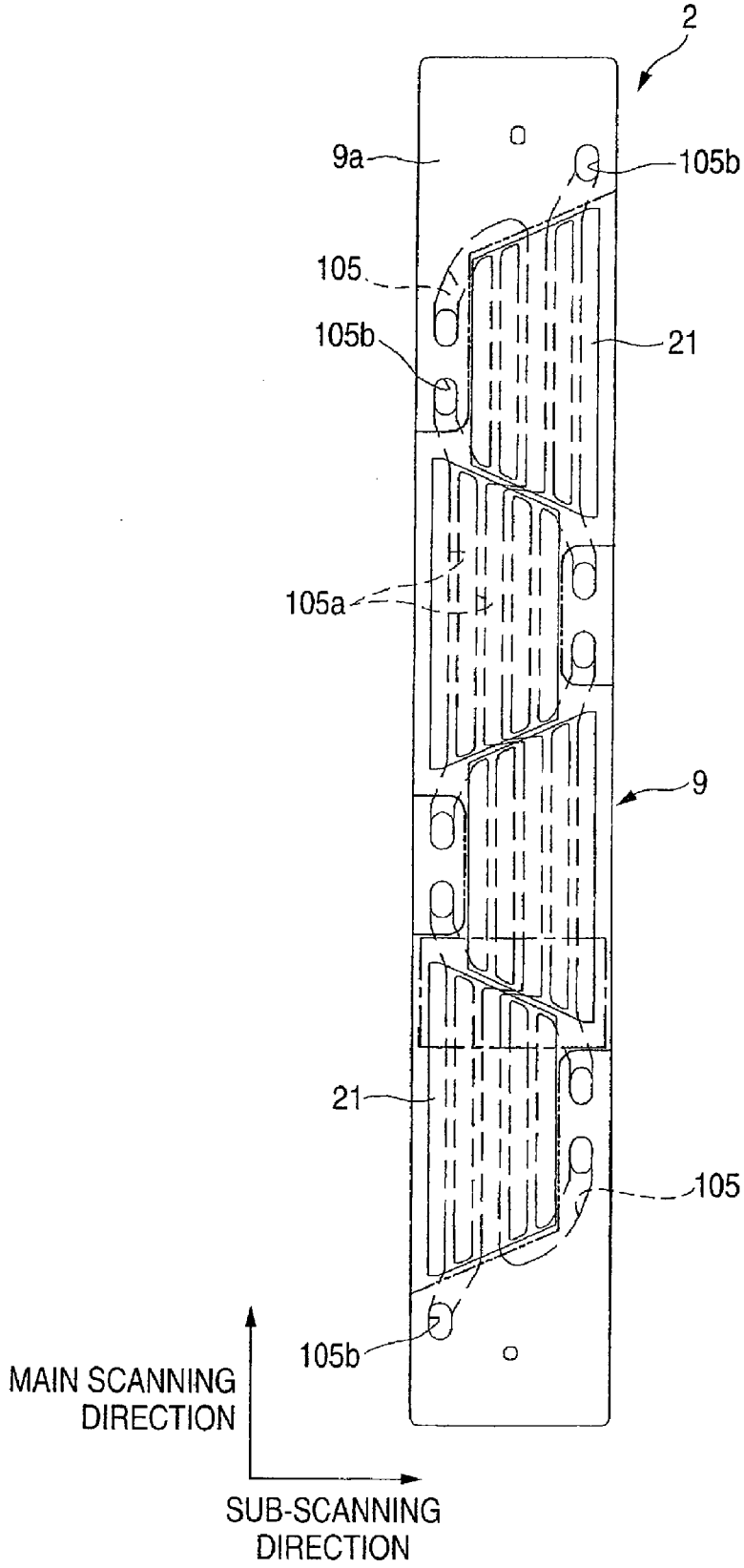
FIG. 3 a plan view of a head body shown in FIG. 2.
Figure 4:
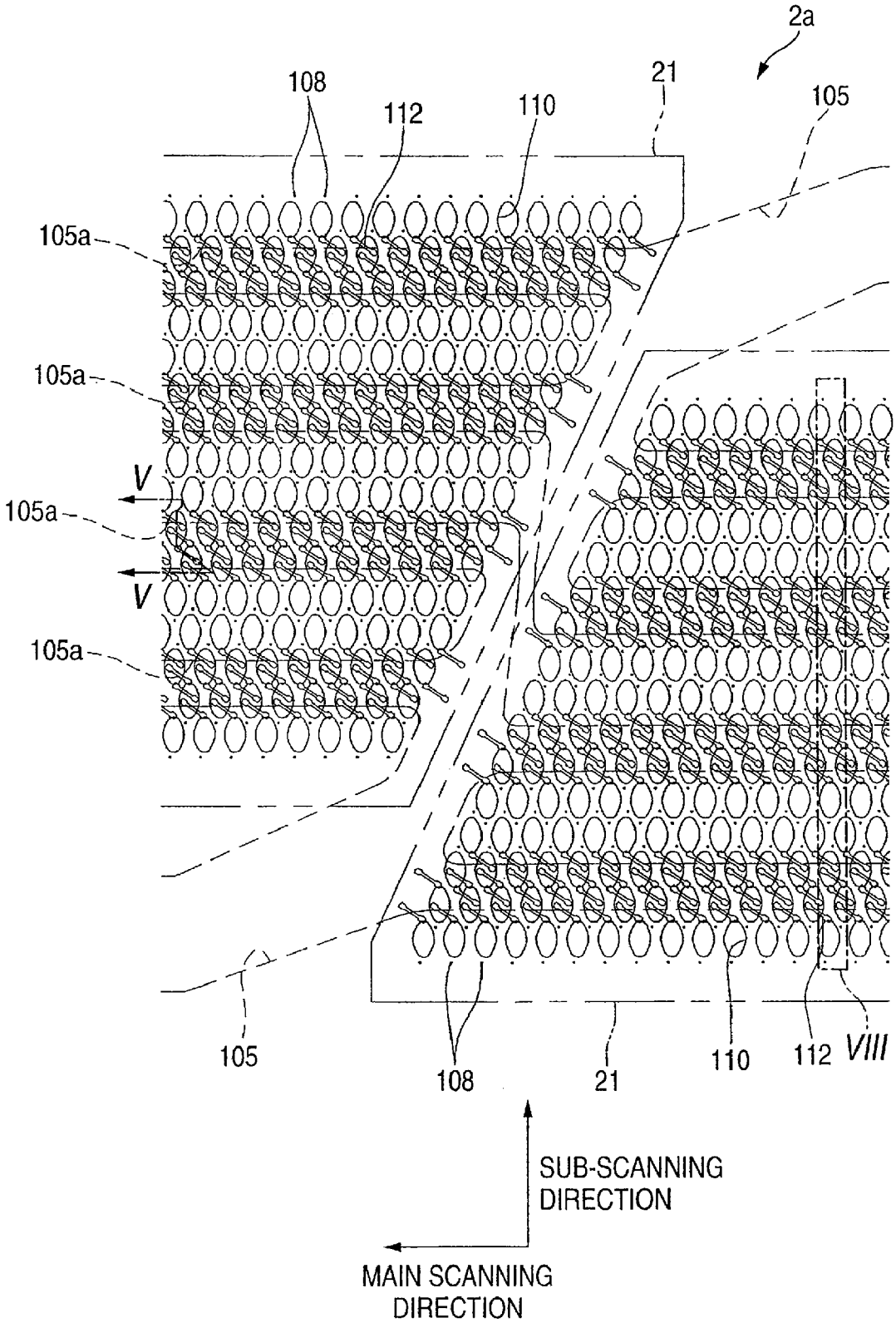
FIG. 4 is an enlarged view of a region surrounded by one-dot chain lines shown in FIG. 3.
Figure 5:
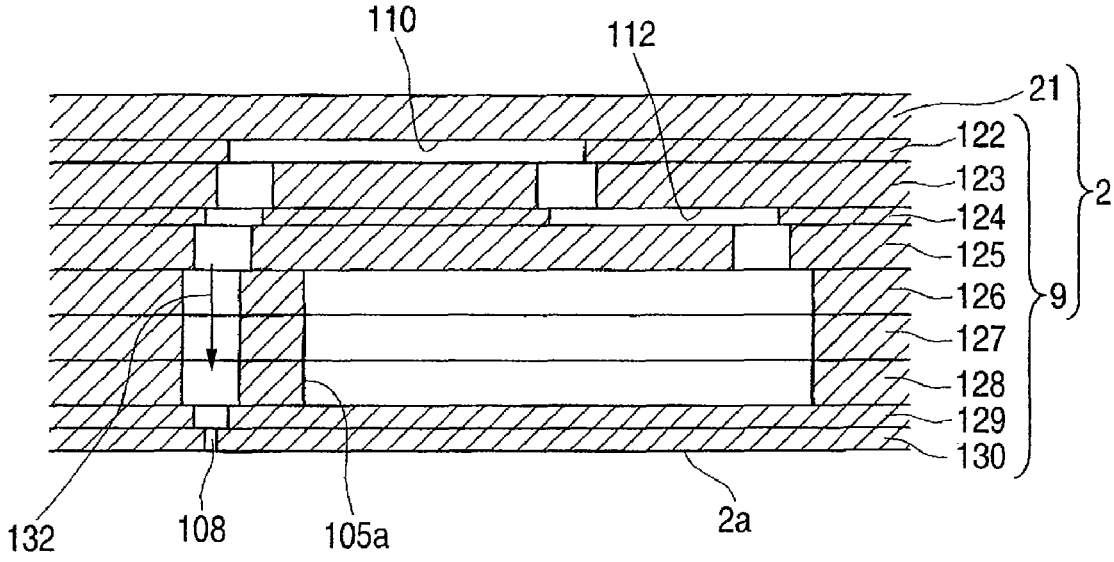
FIG. 5 is a cross-sectional view taken along the line V-V of FIG. 4.
Figure 6A:
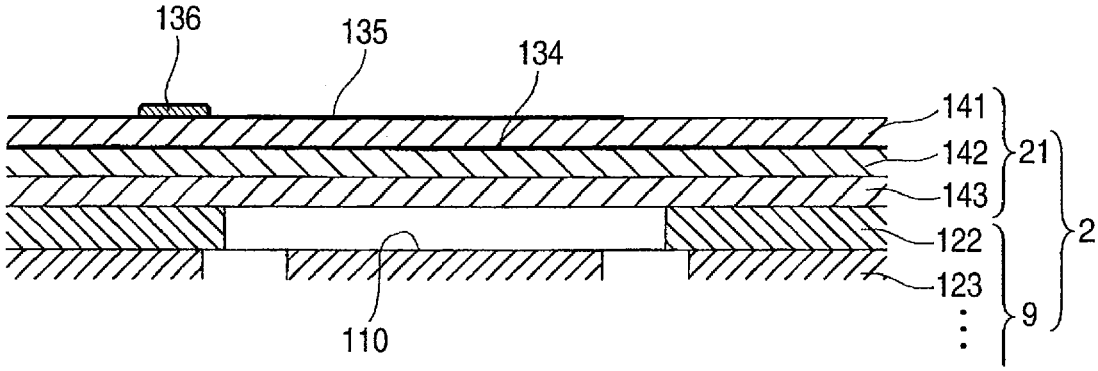
FIGS. 6A and 6B are views for explaining an actuator unit shown in FIG. 4.
Figure 6B:
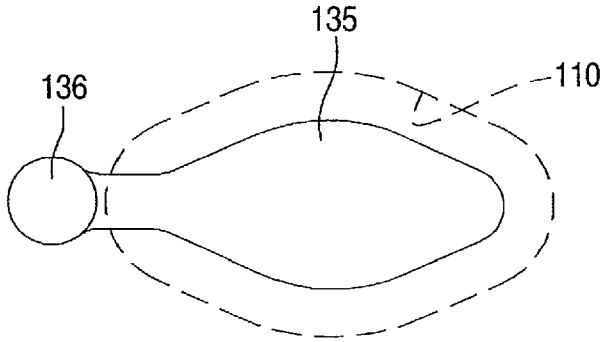

Next, the head body 2 will be described referring to FIGS. 3 to 6. FIG. 3 is a plan view of the head body 2. FIG. 4 is an enlarged view of a region surrounded by one-dot chain lines of FIG. 3. In addition, for the sake of description, pressure chambers 110, apertures 112, and nozzles 108 that exist below the actuator units 21 and that should be drawn by broken lines are drawn by solid lines in FIG. 4. FIG. 5 is a partial cross-sectional view taken along the line V-V shown in FIG. 4. FIG. 6A is an enlarged cross-sectional view of one actuator unit 21, and FIG. 6B is a plan view showing individual electrodes disposed on the surface of the actuator unit 21 in FIG. 6A.

As shown in FIG. 3, the head body 2 includes a channel unit 9, and four actuator units 21 fixed to the top surface 9*a* of the channel unit 9. As shown in FIG. 4, ink channels including pressure chambers 110 are formed inside the channel unit 9. The actuator units 21 include a plurality of actuators corresponding to the pressure chambers 110, respectively, and have a function to selectively apply ejection energy to the ink in the pressure chambers 110.

The channel unit 9 is formed in the shape of a rectangular parallelepiped that has almost the same shape in plan view as the plate 94 of the reservoir unit 71. In the top surface 9*a* of the channel unit 9, a total of ten ink supply ports 105*b* are formed in correspondence with the ink outflow channels 62 (refer to FIG. 2) of the reservoir unit 71. As shown in FIGS. 3 and 4, a manifold channel 105 that communicates with the ink supply ports 105*b*, and sub-manifold channels 10*a* (an example of a common ink chamber) that branch from the manifold channel 105 are formed inside the channel unit 9. As shown in FIGS. 4 and 5, the ink ejection surface 2*a* in which a number of nozzles 108 are disposed in a matrix is formed in the bottom surface of the channel unit 9. A number of pressure chambers 110 are arrayed in a matrix similarly to the nozzles 108, in the fixed surfaces of the actuator units 21 in the channel unit 9.

In the present embodiment, sixteen rows of the pressure chambers 110 that are arranged at equal intervals in the longitudinal direction of the channel unit 9 are arrayed parallel to one another in the lateral direction. The pressure chambers 110 included in each pressure chamber row are disposed in correspondence with the profile shape (trapezoidal shape) of the actuator units 21 to be described later so that the number thereof may decrease gradually toward the short side of the profile shape from the long side thereof. Similarly to this, the nozzles 108 are also disposed.

As shown in FIG. 5, the channel unit 9 is constituted by nine metal plates of stainless steel, etc., including a cavity plate 122, a base plate 123, an aperture plate 124, a supply plate 125, manifold plates 126, 127, and 128, and a cover plate 129, and a nozzle plate 130 in order from above. These plates 122 to 130 have a rectangular plane that is long in a main scanning direction (an example of the second direction).

A number of through-holes corresponding to the ink supply ports 105*b* (refer to FIG. 3) and a number of substantially rhomboidal through-holes corresponding to the pressure chambers 110 are formed in the cavity plate 122. With respect to each pressure chamber 110, the base plate 123 is formed with a communication hole between the pressure chamber 110 and an aperture 112 and a communication hole between the pressure chamber 110 and a nozzle 108, and is formed with a communication hole (not shown) between an ink supply port 105*b* and the manifold channel 105. With respect to each pressure chamber 110, the aperture chamber 124 is formed with a communication hole that becomes the aperture 112 and a communication hole between the pressure chamber 110 and the nozzle 108, and is formed with a communication hole (not shown) between the ink supply port 105*b* and the manifold channel 105. With respect to each pressure chamber 110, the supply plate 125 is formed with a communication hole between the aperture 112 and a sub-manifold channel 105*a* and a communication hole between the pressure chamber 110 and the nozzle 108, and is formed with a communication hole (not shown) between the ink supply port 105*b* and the manifold channel 105. With respect to each pressure chamber 110, the manifold plates 126, 127, and 128 are formed with through-holes between the pressure chamber 110 and the nozzle 108, and through-holes that are connected with one another at the time of lamination, and thereby become the manifold channel 105 and the sub-manifold channel 105*a*. With respect to each pressure chamber 110, the cover plate 129 is formed with a communication hole between the pressure chamber 110 and the nozzle 108. With respect to each pressure chamber 110, the nozzle plate 130 is formed with a hole corresponding to the nozzle 108.

By registering and laminating these plates 122 to 130 on each other, a number of individual ink channels 132 that lead to the nozzles 108 through the sub-manifold channels 105*a* from the manifold channel 105, and then through the pressure chambers 110 from outlets of the sub-manifold channels 105*a* to the nozzles 108 are formed in the channel unit 9.

Next, the flow of ink in the channel unit 9 will be described. As shown in FIGS. 3 to 5, the ink supplied into the channel unit 9 via the ink supply ports 105*b* from the reservoir unit 71 is branched from the manifold channel 105 to the sub-manifold channels 105*a*. The ink in the sub-manifold channels 105*a* flows into the individual ink channels 132, and leads to the nozzles 108 via the apertures 112 and the pressure chambers 110 that function as diaphragms.

The actuator units 21 will be described. As shown in FIG. 3, four actuator units 21 have a trapezoidal shape in plan view, and are disposed in a zigzag pattern so as to avoid the ink supply ports 105*b*. Moreover, the parallel opposite sides of each actuator unit 21 runs along the longitudinal direction of the channel unit 9, the oblique sides of actuator units 21 that are adjacent to each other overlap each other in the width direction (sub-scanning direction; an example of the second direction) of the channel unit 9.

As shown in FIG. 6A, each actuator unit 21 is constituted by three piezo-electric sheets 141 to 143 made of a plumbum-zirconate titanate-based (PZT) ceramic material that has ferroelectricity. All the piezo-electric sheets 141 to 143 are continuous flat plates having such a size that they extend over a plurality of pressure chambers 110. An individual electrode 135 is formed in a position on the uppermost piezo-electric sheet 141 that faces a pressure chamber 110. Between the uppermost piezo-electric sheet 141 and the underlying piezo-electric sheet 142, a common electrode 134 that is formed on the whole sheet surface is interposed. As shown in FIG. 6B, the individual electrode 135 has a substantially rhomboidal shape in plan view, which is analogous to a pressure chamber 110. In plan view, an analogous portion of the individual electrode 135 is within the region of the pressure chamber 110. One of acute angle portions in the substantially rhomboidal individual electrode 135 having round angle portions extends outward of the pressure chamber 110, and a circular land 136 electrically connected to the individual electrode 135 is provided at the tip of the acute angle portion.

The common electrode 134 applies ground potential equally in regions corresponding to all the pressure chambers 110. On the other hand, the individual electrode 135 is electrically connected to each terminal of the driver IC 52 via each land 136 and an internal wiring line of the COF 50 so that a driving signal from the driver IC 52 may be input selectively. That is, the portion of the actuator unit 21 that is sandwiched between the individual electrode 135 and the pressure chamber 110 serves as an individual actuator, and a plurality of actuators corresponding to the number of pressure chambers 110 are built in the actuator unit.

Here, a driving method of the actuator unit 21 will be described. The piezo-electric sheet 141 is polarized in its thickness direction, and if an electric field is applied to the piezo-electric sheet 141 in the polarization direction such that the individual electrode 135 has potential different from the common electrode 134, an electric-field applying portion in the piezo-electric sheet 141 serves as an active portion that is distorted by a piezoelectric effect. For example, if the polarization direction and the applying direction of an electric field are the same, the active portion will shrink in a direction (in-plane direction) orthogonal to the polarization direction. That is, the actuator unit 21 is a so-called uni-morph type actuator with the one upper piezo-electric sheet 141 apart from the pressure chamber 110 being as a layer including an active portion, and with the two lower piezo-electric sheets 142 and 143 near the pressure chamber 110 being as a non-active layer. As shown in FIG. 6A, the piezo-electric sheets 141 to 143 are fixed to the top surface of the cavity plate 122 that defines the pressure chamber 110. Therefore, if a difference is caused in distortion in planar direction between the electric-field applying portion in the piezoelectric sheet 141, and the underlying piezo-electric sheets 142 and 143, all the piezo-electric sheets 141 to 143 will deform (uni-morph deformation) so as to become convex toward the pressure chamber 110. This allows pressure (ejection energy) to be applied to the ink in the pressure chamber 110, thereby discharging ink droplets from a nozzle 108.

In addition, in the present embodiment, a predetermined potential is applied to the individual electrode 135 in advance, and whenever ejection is needed, the individual electrode 135 is first made to have a ground potential, and then, a driving signal that applies the predetermined potential again to the individual electrode 135 with predetermined timing is made to be output from the driver IC 52. In this case, the piezo-electric sheets 141 to 143 return to their original states with such timing that the individual electrode 135 has ground potential, the volume of the pressure chamber 110 increases as compared with its initial state (state where a voltage is applied in advance), and ink is absorbed from a sub-manifold channel 105*a* to an individual ink channel 132. Thereafter, all the portions of the piezo-electric sheets 141 to 143 that face an active region deform so as to become convex toward the pressure chamber 110 with such timing that the predetermined potential is applied again to the individual electrode 135, and the pressure of ink rises due to a reduction in the volume of the pressure chamber 110, and ink is ejected from a nozzle 108.

Figure 7:
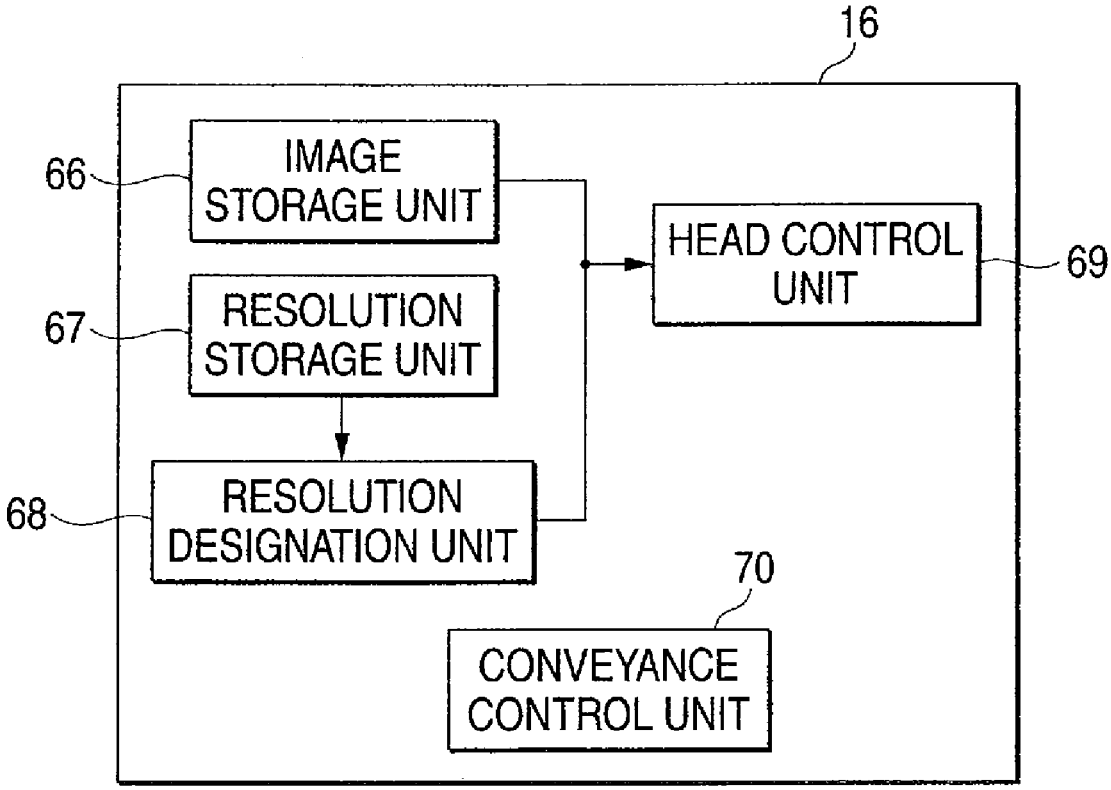
FIG. 7 is a functional block diagram of a control device shown in FIG. 1.

Next, the control device 16 will be described referring to FIG. 7. FIG. 7 is a functional block diagram of the control device 16. As shown in FIG. 7, the control device 16 has an image storage unit 66, a resolution storage unit (an example of a storage unit) 67, a resolution designation unit (an example of a resolution designation unit) 68, a head control unit (an example of a head control unit) 69, and a conveyance control unit 70. The image storage unit 66 stores image data on an image to be printed on a sheet P, which is transmitted from a host apparatus (for example, host computer), such as a PC (Personal Computer). The resolution storage unit 67 stores the kind of resolution of an image that the ink-jet printer 101 should print on a sheet P. Specifically, the resolution storage unit 67 can store at least one kind of resolution (hereinafter referred to as main scanning direction resolution; the number of kind of the main scanning direction resolution is defined as m (m is an integer of one or more)) relating to the direction (main scanning direction) orthogonal to the conveying direction of a sheet P, and at least one kind of resolution (hereinafter referred to as sub-scanning direction resolution; the number of kind of the sub-scanning direction resolution is defined as n (n is an integer of one or more)) relating to the conveying direction (sub-scanning direction) of a sheet P. In this embodiment, three kinds of resolutions, i.e., 150 dpi, 300 dpi, and 600 dpi, are stored with respect to the main scanning direction resolution (i.e., m=3), and two kinds (n) of resolutions, i.e., 300 dpi and 600 dpi, are stored with respect to the sub-scanning direction resolution (i.e., n=2). The resolution designation unit 68 instructs the head control unit 69 that an image should be formed on a sheet P with any main scanning direction resolution and any sub-scanning direction resolution among the resolutions stored in the resolution storage unit 67 according to an instruction from a host computer.

The head control unit 69 controls driving of each ink-jet head 1 in line with the conveyance speed of a sheet P so that an image may be formed on the sheet P with the main scanning direction resolution and sub-scanning direction resolution that are designated by the resolution designation unit 68.

The conveyance control unit 70 controls driving of the belt conveyor mechanism 13 so that a sheet P may be conveyed at a conveyance speed designated by the host computer. As the conveyance speed of a sheet P, there are a normal printing speed and a high printing speed that is twice the normal printing speed.

Figure 8:
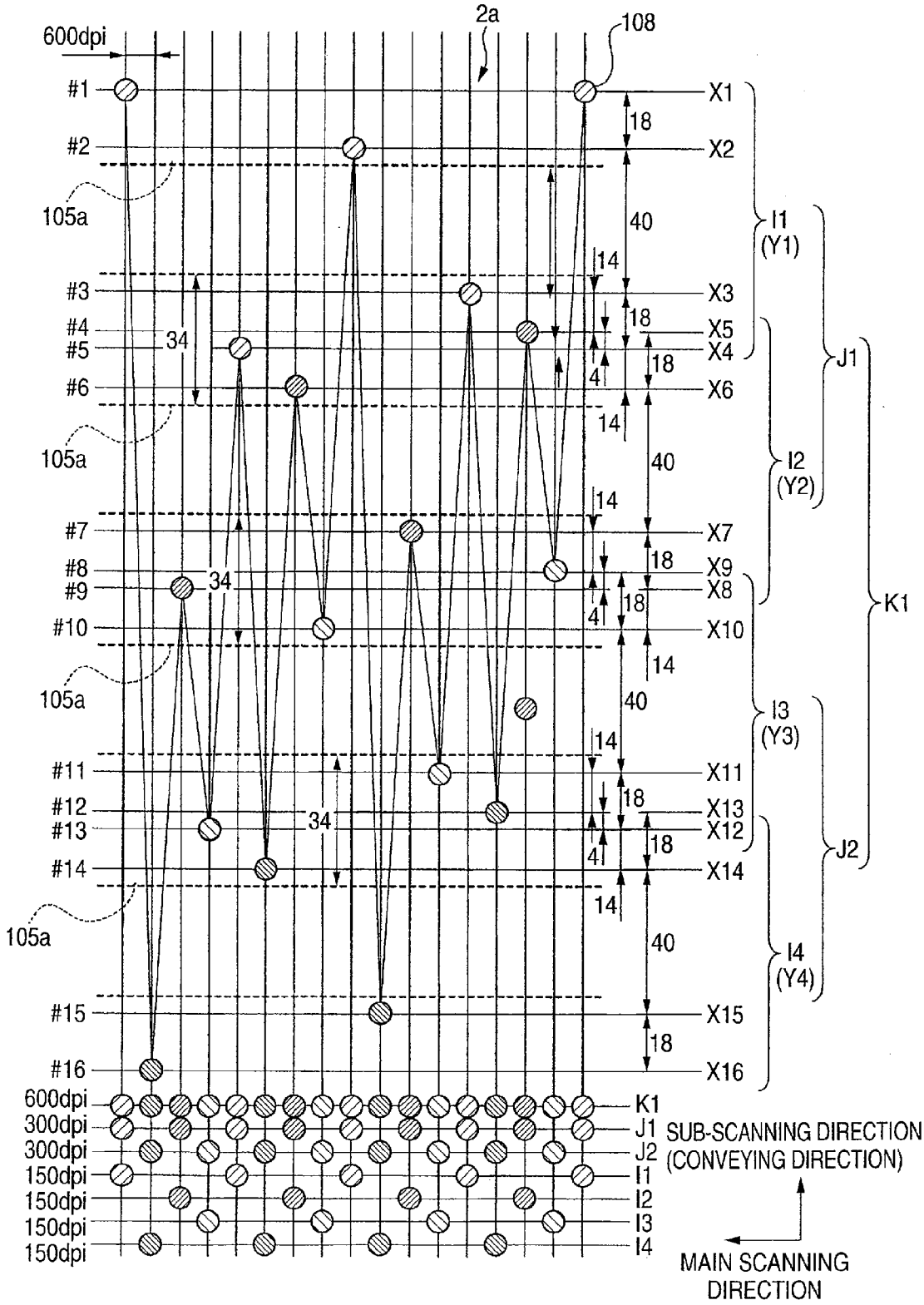
FIG. 8 is a partially enlarged plan view of an ink ejection surface of a region surrounded by one-dot chain lines VIII shown in FIG. 4, showing the positional relationship between the nozzles.

Next, the relationship between the positions of nozzles 108 in an ink ejection surface 2*a*, and the main scanning direction resolution and sub-scanning direction resolution will be described referring to FIG. 8. FIG. 8 is a partially enlarged plan view of the ink ejection surface 2*a* of a region surrounded by one-dot chain lines VIII shown in FIG. 4, which shows the positional relationship between the nozzles 108. In addition, FIG. 8 is an enlarged view of belt-like virtual regions that face one actuator unit 21, and extend in one direction. Further, the horizontal direction of FIG. 8 is a main scanning direction (direction orthogonal to the conveying direction), and the vertical direction thereof is a sub-scanning direction (conveying direction). In FIG. 8, scales in the main scanning direction and sub-scanning direction are changed for the sake of description.

One nozzle 108 that belongs to each nozzle set to be described later is disposed in each belt-like region of FIG. 8. A certain belt-like region is equivalent to a base unit region in a case where an image is formed at 600 dpi that is a highest resolution of the main scanning direction resolutions. In a central portion in the main scanning direction in a region that faces one actuator unit 21, base unit regions are arranged to be repeated two or more times in the main scanning direction. Both end portions in the main scanning direction become triangular regions corresponding to the inclination of the oblique sides of the actuator unit 21, and the number of nozzles to be included according to the inclination of the oblique sides decrease in the belt-like regions that are assumed herein. In addition, in this oblique side portion, adjacent actuator units 21 overlap each other in the sub-scanning direction. Therefore, nozzles 108 of a belt-like region of the oblique side portion are complementarily combined with nozzles 108 included in a belt-like region where adjacent actuator units 21 overlap each other in the sub-scanning direction. This realizes a resolution of 600 dpi in the main scanning direction of the ink-jet head 1.

As shown in FIG. 8, in the ink ejection surface 2*a*, nozzles 10B are arrayed in a matrix in the main scanning direction and sub-scanning direction. Specifically, each nozzle 108 is disposed on any one of imaginary lines #1 to # 16 that extend parallel to one another along the main scanning direction. A plurality of nozzles 108 disposed on the individual imaginary lines #1 to #16 form nozzle sets X1 to X16, respectively. The imaginary lines #1 to #16 (nozzle sets X1 to X16) that are adjacent to one another in the sub-scanning direction are spaced apart from each other by any one of 4/600 inch, 14/600 inch, 18/600 inch, and 40/600 inch in the sub-scanning direction. All of these spaced distances become a distance that is an integral multiple of a distance that is obtained by multiplying 1/600 inch, which is a unit distance of 600 dpi that is a highest resolution of two kinds of sub-scanning direction resolutions stored in the resolution storage unit 67, by 2 ($2^{n-1}$: n=2, in this embodiment).

As described above, the actuator unit 21 has a trapezoidal profile shape, and the array of nozzles 108 is also distributed in a trapezoidal region. In this distribution region, the upper base of the trapezoid is on the downstream side in the conveying direction (sub-scanning direction). Supposing nozzle sets are disposed toward the downstream side in order of nozzle sets X16→X15→X14→ X12→X13→ X11→ X10→X8→X9→X7→X6→X4→X5→X3→X2→X1, as a nozzle set is located closer to the upper base, the number of nozzles 108 belonging to this nozzle set decreases.

Further, in the present embodiment, as shown in FIG. 3 and FIG. 4, four trapezoidal distribution regions are juxtaposed at predetermined intervals in the longitudinal direction (main scanning direction) of the nozzle plate 130. The lower base of a trapezoid is closer to the end of the nozzle plate 130 in the lateral direction (sub-scanning direction) than the upper base thereof. That is, the four trapezoidal distribution regions are alternately disposed as equal distances in opposite directions parallel to the lateral direction with respect to the center of the nozzle plate 130 in the lateral direction. Further, parallel opposite sides of each trapezoidal distribution region are disposed along the main scanning direction. Therefore, in two trapezoidal distribution regions that are adjacent to each other across one trapezoidal distribution region, corresponding nozzle sets are arranged linearly in the main scanning direction. For example, nozzle sets that exist on the most downstream side in the conveying direction are disposed linearly. On the other hand, one sandwiched trapezoidal distribution region is spaced apart by a predetermined distance in the lateral direction with respect to two trapezoidal distribution regions that sandwich it. Here, the spaced distance is 100/600 inch, and becomes a distance that is an integral multiple of a distance that is obtained by multiplying 1/600 inch by $2^{n-1}$ similarly to a distance rule between nozzle sets. That is, if adjacent trapezoidal distribution regions are seen, nozzle sets that exist on the most downstream side in the conveying direction are also spaced apart by 100/600 inch.

All the nozzles 108 that belong to the nozzle sets that are arranged linearly in the main scanning direction and the nozzle sets that are spaced apart by 100/600 inch are arrayed at equal intervals corresponded to a resolution in the main scanning direction of the nozzle plate 130. For example, in the nozzle set that exist on the most downstream side in the conveying direction, the nozzles 108 are arrayed at intervals corresponding to a resolution of 37.5 dpi. In a combination of nozzle sets in such positional relationship, nozzles 108 are disposed at the same intervals as above. Further, the number of nozzles 108 to be included in each combination is also the same.

Here, the head control unit 69 controls driving of the ink-jet head 1 according to a sub-scanning direction resolution designated by the resolution designation unit 68. In addition, in a case where a sheet P is conveyed at a normal printing speed by the belt conveyor mechanism 13, printing is allowed with any of the sub-scanning direction resolutions of 600 dpi and 300 dpi. However, in a case where a sheet P is conveyed at a high printing speed, printing is performed only at the sub-scanning direction resolution of 300 dpi by restrictions on data transmission rate from a host computer or data processing speed. When printing is performed with the sub-scanning direction resolution of 600 dpi in a case where a sheet P is conveyed at a normal printing speed, and when printing is performed with the sub-scanning direction resolution of 300 dpi in a case where a sheet P is conveyed at a high printing speed that is twice a normal printing speed, the ink ejection periods from the ink-jet head 1 are the same. The ink ejection periods at this time coincide with an integral multiple of the control period of the head control unit 69. Accordingly, at a normal printing speed, an ink ejection period when printing is performed with the sub-scanning direction resolution of 300 dpi coincides with a period that is twice a control period.

When printing is performed by the ink-jet head 1 having the above-mentioned configuration, for example, when printing is performed at a normal printing speed with a one-level lower resolution without changing a control period, it may take a long ink ejection period. In performing printing at 300 dpi, as described above, a period that is twice the ink ejection period of 600 dpi is taken. Specifically, the ink ejection period at 300 dpi is taken by counting the ink ejection period of 600 dpi twice. Supposing that printing is performed at 150 dpi, a period that is twice the period of 300 dpi is taken. In a case where such an ink-jet head 1 is used at a high printing speed, if the conveyance speed of a sheet P is doubled even in the driving condition of the head that can perform printing with a highest resolution (600 dpi) at a normal printing speed, printing will be performed at 300 dpi as a resolution in the sub-scanning direction.

The ink-jet head 1 can perform printing of a highest resolution 600 dpi at a normal printing speed. Therefore, if the above printing is performed, in any case, adjacent in the main scanning direction to a dot that is formed on a sheet P by one nozzle 108 will be disposed a dot that is formed by a nozzle 108 adjacent to this nozzle 108. Here, in order to be timed with the movement of a sheet P from one nozzle 108 to another nozzle 108, the time corresponding to the spaced distance between both the nozzles is counted. Depending on the relationship between a control period and an ink ejection period, if the spaced distance between both the nozzles are an odd multiple of 1/600 inch, this time will by obtained by counting the time that is an odd multiple of an ink ejection period in a highest resolution at a normal a printing speed.

A case in which such an ink-jet head 1 is applied to an apparatus that performs high-speed printing (for example, the conveyance speed is twice) with the same highest resolution of 600 dpi as a normal printing speed will be discussed. In addition, suppose that the control period does not change.

If a consideration is taken in context with the above-mentioned method, it is desirable to shorten the ink ejection period. That is, a period (time) equivalent to half of the ink ejection period of 600 dpi at a normal printing speed is used. Here, when the nozzle interval is an odd multiple of 1/600 inch poses a problem. In a case where the ink-jet head 1 counts the time that is an odd multiple of an ink ejection period in a highest resolution at a normal printing speed, thereby registering dots in the main scanning direction, which are formed by nozzles 108 having this relation, since the time (period) that is half of an odd multiple of this ink ejection period cannot be counted, positional deviation is caused between the dots formed by these two nozzles 108. However, in the present embodiment, all the nozzle intervals become a distance that is an integral multiple of a distance that is obtained by multiplying 1/600 inch by $2^{n-1}$ In order to register the printing positions of dots, an ink ejection period when a highest resolution is given at a normal printing speed is counted by at least even times. Moreover, the above half period (time) can also be counted. Therefore, the ink-jet head 1 can be easily applied to an apparatus that performs high-speed printing with the same highest resolution of 600 dpi as a normal printing speed. At this time, the configuration of a circuit that drives the ink-jet head 1 does not need to be complicated, or expensive components do not need to be used.

As described above, in a case in which the ink-jet head is applied to an apparatus that performs high-speed printing (conveyance speed is twice) with the same highest resolution of 600 dpi as a normal printing speed without devising a nozzle arrangement, it is necessary to prepare a driver IC and a circuit configured in relation to the driver IC, in correspondence with a nozzle 108 the distance of which from a certain reference position is an even multiple of 1/600 inch, and a nozzle 108 the distance of which from a certain reference position is an odd multiple of 1/600 inch. That is, it is necessary to configure two systems of circuits for an even number and for an odd number. Otherwise, even if such a circuit is configured in one system, it is necessary to configure the circuit with elements that can output ink ejection waveforms for an even number and for an odd number. Performing high-speed printing (for example, the conveyance speed is twice) with the same highest resolution of 600 dpi as a normal printing speed correspond to performing printing with the resolution of 1200 dpi at a normal printing speed in terms of head control. With respect to an ink ejection waveform for an even number, it is necessary to prepare an ink ejection waveform for an odd number that has the same number as the ink ejection waveform for an even number, and is processed so that ejection timing may deviate by 2400 dpi. In any case, the configuration of a circuit will become complicated, or expensive components will be used.

Referring back to FIG. 8, four nozzle sets X1 to X4 form a nozzle set group Y1, four nozzle sets X5 to X8 form a nozzle set group Y2, four nozzle sets X9 to X12 form a nozzle set group Y3, and four nozzle sets X13 to X16 form a nozzle set group Y4.

At the boundaries between the nozzle set groups Y1 to Y4, there are overlaps in the sub-scanning direction. In the present embodiment, this overlap is 4/600 inch, as shown in FIG. 8. That is, the nozzle sets X4, X5, X5, X9, X12, and X13 at the ends of the individual nozzle set groups Y1 to Y4 enter the spread (area) of other nozzle set groups Y1 to Y4 that are adjacent to one another by 4/400 inch. These four nozzle set groups Y1 to Y4 are arrayed in order in the sub-scanning direction. If attention is paid to each of the nozzle set groups Y1 to Y4, all the nozzles 108 belonging to each of the nozzle set groups Y1 to Y4 are arrayed at equal intervals in the main scanning direction. Further, the nozzle set groups Y1 to Y4 to which the nozzles 108 disposed in order in the main scanning direction belong are repeated two or more times in order of nozzle set group Y1→nozzle set group Y4→nozzle set group Y2→nozzle set group Y3 (in a predetermined pattern).

Also, the arrangement patterns of nozzles 108 are substantially the same in the nozzle set groups Y1 to Y4. For example, in the nozzle set group Y1, a pattern is repeated in order of a nozzle 108 in the nozzle set X1, a nozzle 108 in the nozzle set X3→a nozzle 108 in the nozzle set X2→a nozzle 108 in the nozzle set X4 in the main scanning direction. This is a pattern repeated in order of a nozzle 108 on the most downstream side→a nozzle 108 on the third upstream side from the most downstream side a nozzle 108 on the second upstream side from the most downstream side→a nozzle 108 on the fourth upstream side (most upstream side) from the most downstream side, in the sub-scanning direction. This repeated pattern is common to the other nozzle set groups Y2 to Y4. In addition, in each of the nozzle set groups Y1 to Y4 having an arrangement of such nozzles 108, any nozzles 108 do not overlap other nozzles 108 in the sub-scanning direction.

Further, the nozzle set groups Y1 to Y4 form line groups I1 to I4, respectively, the two nozzle set groups Y1 and Y2 are combine together to form a line group J1, the two nozzle set groups Y3 and Y4 are combined together to form a line group J2, and all the nozzle set groups Y1 to Y4 are combined together to form a line group K1. In other words, the nozzle set groups Y1 to Y4 in units of $2^k$ ($0 \leqq k \leqq 2$ in this embodiment) that appear in order from one side (upside of FIG. 8) in the sub-scanning direction form three kinds of line groups I, J, and K (i.e., I1 to I4, J1 and J2, and K1). The kind of nozzle set group I, J, and K corresponds to the numbers of k. For example, when k=1, the kind of the nozzle set group is "J," and 2 ($=2^1$) nozzle set groups of the nozzle set groups Y1 to Y4 are allocated to the line group J1 and J2 in order from one side (downstream end; Y1→Y4). Nozzles 108 belonging to each of the line groups I1 to I4 are arrayed at intervals of 150 dpi in the main scanning direction. Also, nozzles 108 belonging to each of the line groups J1 and J2 are arrayed at intervals of 300 dpi in the main scanning direction. Further, nozzles 108 belonging to the line group K1 are arrayed at intervals of 600 dpi in the main scanning direction. As such, the line groups I1 to I4, J1 and J2, and K1 correspond to the kinds of main scanning direction resolution that are stored by the resolution storage unit 67. Specifically, the line groups I1 to I4 correspond to the main scanning direction resolution 150 dpi, the line group J1 and J2 correspond to the main scanning direction resolution 300 dpi, and the line group K1 correspond to the main scanning direction resolution 600 dpi.

Further, in each of the line groups J1, J2, and K1 (each of the line groups excluding resolution 150 dpi corresponding to a lowest main scanning direction resolution), in an intermediate position between two nozzles 108 that belong to one line group I1 to I4, J1, or J2 corresponding to one-level lower main scanning direction resolution (an example of a sub line group) and are adjacent to each other in the main scanning direction, a nozzle 108 that belongs to other line groups I1 to I4, J1, and J2 that are adjacent to the one line group I1 to I4, J1, or J2 in the sub-scanning direction is disposed.

Specifically, as shown in FIG. 8, in the line group J1 (main scanning direction resolution 300 dpi), in an intermediate position between two nozzles 108 that are adjacent to each other in the main scanning direction in the line group I1 having one-level lower resolution (main scanning direction resolution 150 dpi), a nozzle 108 in the line group I2 is disposed. These two line groups I1 and I2 are adjacent to each other in the sub-scanning direction. Further, in each of the line groups I1 to I4, J1, J2, and K1, two nozzles 108 that are adjacent to one nozzle 108 in the main scanning direction are disposed either above or below the one nozzle in the sub-scanning direction (on the upstream side or downstream side in the conveying direction). Also, if the line group K1 having a highest resolution is contemplated, two nozzles 108 that are adjacent to one nozzle 108 are disposed either above or below the one nozzle in the sub-scanning direction via one or more nozzle sets X1 to X16. In other words, in each of the line groups I1 to I4, J1, J2, and K1, nozzles 108 are disposed in a zigzag pattern along the main scanning direction.

If nozzles 108 that are adjacent to each other in the main scanning direction are adjacent to each other even in the sub-scanning direction when printing is performed with high resolution, a dot will be formed by a downstream nozzle 108 before a dot formed by a nozzle 108 located on the upstream side in the sub-scanning direction is sufficiently dried. Since a plurality of colors of ink overlap each other on a sheet P in performing color printing, there is a possibility that deformation of a sheet P may occur. Deformation of a sheet P damages the ink ejection surface 2*a*, or causes sheet jamming. However, in the present embodiment, at least in the line group K1 corresponding to a highest resolution, one or more nozzle sets X1 to X16 are interposed between nozzles 108 in the sub-scanning direction, such a trouble is not caused. In addition, since the interval between adjacent nozzles 108 is wide when printing is performed with low resolution, such a trouble is hardly caused.

Here, the head control unit 69 suitably selects each of the line groups I1-I4, J1, J2, and K1 according to a main scanning direction resolution designated by the resolution designation unit 68, and controls driving of an ink-jet head 1 so that ink droplets may be ejected from nozzles 108 belonging to the line groups I1 to I4, J1, J2, and K1 in units of the selected line group I1 to I4, J1, J2, and K1.

Next, the positional relationship between the nozzles 108 and the sub-manifold channels 105*a* will be described. As shown in FIG. 8, four sub-manifold channels 105*a* that extend along the main scanning direction are arrayed along the sub-scanning direction. Sub-manifold channels 105*a* that are adjacent to each other in the sub-scanning direction are spaced apart from each other in the sub-scanning direction at pitches of 72/600 inch via an interval of 34/600 inch. This spaced distance (pitch) is a distance that is an integral multiple of a distance that is obtained by multiplying 1/600 inch, which is a unit distance of 600 dpi, by 2 ($2^{n-1}$: n=1). Also, the four sub-manifold channels 105*a* communicate with the nozzle set groups Y1 to Y4, respectively, which are disposed in the vicinity of the sub-manifold channels 105*a* as seen from a direction orthogonal to the ink ejection surface 2*a*. This allows the nozzle set groups Y1 to Y4 to communicate with the sub-manifold channels 105*a* that are different from one another. Further, in the nozzle sets X1 to X16 belonging to the nozzle set groups Y1 to Y4, respectively, the spaced distance between the nozzle sets X1 to X16 that are adjacent to each other as seen from the direction orthogonal to the ink ejection surface 2*a* become the greatest between the nozzle sets X2, X3, X6, X7, X10, X11 disposed on both sides of the corresponding sub-manifold channels 105*a*. With an arrangement where nozzles 108 are unevenly distributed between the sub-manifold channels 105*a*, it is possible to secure the capacity of the sub-manifold channels 105*a* while enhancing the degree of integration of the individual ink channels 132. In this embodiment, each of the sub-manifold channels 105*a* is arranged in a center of the respective nozzle set group with respect to the sub-scanning direction. In addition, the nozzle sets in each of the nozzle set groups are symmetrically arranged with respect to the respective common chamber in the sub-scanning direction.

According to the present embodiment described hitherto, the nozzle sets X1 to X16 are spaced apart from each other in the sub-scanning direction by a distance that is an integral multiple of a distance that is obtained by multiplying 1/600 inch, which is a unit distance of 600 dpi that is a highest resolution of two kinds of sub-scanning direction resolutions, by 2. Therefore, even in a case where printing is performed with any sub-scanning direction resolution of 600 dpi and 300 dpi that are different by a multiple in the sub-scanning direction resolution from each other, ink droplets are ejected with the same timing. Therefore, a dot will be formed in a given position on a sheet P. As a result, deterioration of printing quality in all the sub-scanning direction resolutions can be suppressed. Further, since it is not necessary to shorten the control period, the cost of the control device 16 can be prevented from becoming high.

Further, since ink droplets are ejected with the same timing even in a case in which the sub-scanning direction resolution is lowered to 300 dpi when a sheet P is conveyed at a high printing speed, a dot can be formed in a given position on the sheet P.

Moreover, since the four nozzle set groups Y1 to Y4 are disposed in order in the sub-scanning direction, and all the nozzles 108 that belong to each of the nozzle set groups Y1 to Y4 are arrayed at equal intervals of 150 dpi in the main scanning direction, each of the nozzle set groups Y1 to Y4 can be handled as an ink-jet head of 150 dpi that is virtually independent. At this time, since the arrangement patterns of nozzles 108 are substantially the same in the nozzle set groups Y1 to Y4, the controls for allowing ink droplets to be ejected from the nozzle set groups Y1 to Y4 become substantially the same. This facilitates control of an ink-jet head 1.

In particular, the nozzle set groups Y1 to Y4 to which the nozzles 108 disposed in order in the main scanning direction belong are repeated two or more times in order of nozzle set group Y1→nozzle set group Y4→nozzle set group Y2→nozzle set group Y3. In an intermediate position between two nozzles 108 that are adjacent to each other in the main scanning direction in each of the line groups I1 to I4, J1, and J2, a nozzle 108 that belongs to other line groups I1 to I4, J1, and J2 that are adjacent to the one line group in the sub-scanning direction is disposed. For this reason, a main scanning direction resolution can be easily changed by suitably selecting the nozzle set groups Y1, Y2, Y3, and Y4 as the line groups I1 to I4, J1, J2, and K1, and by controlling the ink-jet head 1 in units of the line groups I1 to I4, J1, J2, and K1.

Further, since nozzles 108 belonging to each of the line groups I1 to I4, J1, J2, and K1 are disposed in a zigzag pattern along the main scanning direction, it is possible to keep ink droplets ejected from nozzles 108 that are adjacent to each other in the main scanning direction from being mixed together on a paper P before being dried.

Further, in the embodiment, sub-manifold channels 105*a* that are adjacent to each other in the sub-scanning direction are spaced apart from each other in the sub-scanning direction at pitches of 72/600 inch via an interval of 34/600 inch, and four sub-manifold channels 105*a* communicate with the nozzle set groups Y1 to Y4, respectively, which are disposed in the vicinity of the sub-manifold channels 105*a* as seen from a direction orthogonal to the ink ejection surface 2*a*. Therefore, the distance between the sub-manifold channels 105*a* and the individual ink channels 132 becomes short, and the degree of integration of the individual ink channels 132 can be enhanced.

At this time, in the nozzle sets X1 to X16 belonging to the nozzle set groups Y1 to Y4, respectively, the spaced distance between the nozzle sets X1 to X16 that are adjacent to each other as seen from the direction orthogonal to the ink ejection surface 2*a* becomes the greatest between the nozzle sets X2, X3, X6, X7, X10, X11 disposed on both sides of the corresponding sub-manifold channels 105*a*, the capacity of the sub-manifold channels 105*a* can be secured.

In the present embodiment described above, an ink-jet head 1 correspond to a single color, and a color image is formed on a sheet P by four ink-jet heads 1 that eject ink droplets of four mutually different colors. However, ink droplets of four colors can be ejected by one ink-jet head 1 by making four sub-manifold channels 105*a* of an ink-jet head 1 into independent structures and by supplying four mutually different color inks to the four sub-manifold channels 105*a*, respectively. In this case, each of the line groups I1 to I4 will be handled as an independent ink-jet head having a main scanning direction resolution of 150 dpi. Accordingly, the head control unit 69 control driving of the ink-jet head 1 so that the main scanning direction resolution may become 150 dpi, and ink droplets are ejected from nozzles 108 belonging to each of the line groups I1 to I4 in units of the line groups I1 to I4.

Furthermore, ink droplets of two colors can be ejected by one ink-jet head 1 by supplying two mutually different color inks to every two sub-manifold channels 105*a*. In this case, each of the line groups J1 and J2 will be handled as an independent ink-jet head having a main scanning direction resolution of 300 dpi. Accordingly, the head control unit 69 control driving of the ink-jet head 1 so that the main scanning direction resolution may become 300 dpi, and ink droplets are ejected from nozzles 108 belonging to each of the line groups J1 and J2 in units of the line groups J1 and J2.

According to this, since ink droplets of two colors or four colors can be ejected by one ink-jet head 1, miniaturization of an ink-jet printer can be achieved. Further, since it is possible to cope with both a single color and multiple colors with ink-jet heads 1 having substantially the same configuration, low cost of the ink-jet heads 1 can be achieved.

Although the embodiments of the invention has been described hitherto, the invention is not limited to the above embodiment, and can be variously changed within the scope set forth in the claims. For example, in the above-described embodiment, all the nozzles 108 belonging to each of the nozzle set groups Y1 to Y4 are arrayed at equal intervals of 150 dpi in the main scanning direction. However, all the nozzles 108 belonging to each of the nozzle set groups Y1 to Y4 are arrayed at intervals other than 150 dpi. Further, although an ink-jet head 1 has four nozzle set groups, it may have an arbitrary number of nozzle set groups so long as the number of groups is a factorial of 2.

Further, in the above-described embodiment, the arrangement patterns of nozzles 108 in the nozzle set groups Y1 to Y4 are substantially the same. Also, in an intermediate position between two nozzles 108 that are adjacent to each other in the main scanning direction in each of the line groups I1 to I4, J1, and J2, a nozzle 108 that belongs to other line groups I1 to I4, J1, and J2 that are adjacent to the one line group in the sub-scanning direction is disposed. However, the arrangement pattern in each nozzle set group may be arbitrary.

Moreover, in the above-described embodiment, in the nozzle sets X1 to X16 belonging to the nozzle set groups Y1 to Y4, respectively, the spaced distance between the nozzle sets X1 to X16 that are adjacent to each other as seen from the direction orthogonal to the ink ejection surface 2*a* becomes the greatest between the nozzle sets X2, X3, X6, X7, X10, X11 disposed on both sides of the corresponding sub-manifold channels 105*a*. However, the positional relationship between the sub-manifold channels and the nozzle sets X1 to X16 may be arbitrary.

An ink-jet recording apparatus according to the embodiments includes: a conveying unit that conveys a recording medium; an ink-jet head that has an ink ejection surface in which a plurality of nozzles that eject ink droplets to the recording medium conveyed by the conveying unit are formed; a storage unit that stores "n" ($n \geqq 2$) resolutions of an image to be formed on the recording medium in a conveying direction of the recording medium; a resolution designation unit that designate any one of the "n" resolutions stored in the storage unit; and a head control unit that controls driving of the ink-jet head according to a resolution designated by the resolution designation unit. Also, the plurality of nozzles are arrayed in a matrix in the conveying direction and in a direction orthogonal to the conveying direction in the ink ejection surface, the plurality of nozzles arrayed along a direction orthogonal to the conveying direction form nozzle sets, respectively, and the nozzle sets are spaced apart from each other in the conveying direction by a distance that is an integral multiple of a distance that is obtained by multiplying a unit distance, corresponding to a highest resolution among the "n" resolutions stored in the storage unit, by $2^{n-1}$.

According to the embodiments of the invention, the nozzle sets are spaced apart from each other in the conveying direction by a distance that is an integral multiple of a distance that is obtained by multiplying a unit distance, corresponding to a highest resolution in the conveying direction, by $2^{n-1}$. Therefore, even if printing is performed with any one resolution in the conveying direction, of n kinds of resolutions that are different from each other by every multiple in the conveying direction, it is possible to perform control so that an ink droplet may be ejected from each nozzle with the same timing. Accordingly, a dot will be formed in a given position on a recording medium, and consequently, printing quality can be kept from deteriorating in all the resolutions in the conveying direction. Further, since it is not necessary to shorten the control period, the cost of the control device can be prevented from becoming high.

Further, even in a case where the resolution in the conveying direction is lowered due to a problem with the transfer rate of image data when high-speed conveyance of a recording medium is performed in order to perform high-speed printing, a dot can similarly be formed in a given position on a recording medium. Accordingly printing quality can be kept from deteriorating.

In the embodiments, a plurality of nozzle set groups including a plurality of the nozzle sets and to which the same number of the nozzles belong are formed, and the nozzle set groups to which the nozzles disposed in order in the direction orthogonal to the conveying direction belong are repeated in a predetermined pattern. According to this, the resolution in the direction orthogonal to the conveying direction can be easily changed by selecting a nozzle set group that ejects ink droplets.

In the embodiments, a plurality of nozzle set groups including a plurality of the nozzle sets and to which the same number of the nozzles that are disposed in the same pattern belong are formed, a plurality of the nozzle set groups are arrayed along the conveying direction, and all the nozzles belonging to the nozzle set groups are arrayed at equal intervals in the direction orthogonal to the conveying direction. According to this, each nozzle set group can be handled as an ink-jet head that is virtually independent. Further, since each nozzle set group has substantially the same construction, control of every nozzle set group becomes easy.

Moreover, the ink-jet recording apparatus further includes a plurality of common ink chambers that communicate with the nozzle set groups, which are different from one another, respectively. According to this, multicolor ink droplets can be ejected by one ink-jet head. Further, since it is possible to cope with both a single color and multiple colors with ink-jet heads having substantially the same configuration, low cost of the ink-jet heads can be achieved.

The storage unit further stores "m" resolutions ($m \geqq 1$) of an image to be formed on the recording medium in the direction orthogonal to the conveying direction, the nozzle set groups in units of $2^k$ ($0 \leqq k \leqq m-1$) that appear in order from one side in the conveying direction form m kinds of line groups, and in various kinds of line groups excluding the kind corresponding to a lowest resolution, in an intermediate position between two nozzles that belong to one line group corresponding to a resolution that is one-level lower than the kinds and are adjacent to each other in the direction orthogonal to the main scanning direction, a nozzle that belongs to other line groups that are adjacent to the one line group in the sub-scanning direction and are corresponding to a resolution that is one-level lower than the kinds is disposed. According to this, the resolution in the direction orthogonal to the conveying direction for every kind of a line group to be selected can be made different. At this time, since resolution changes in the combination of line groups that are adjacent to each other in the conveying direction, the resolution in the direction orthogonal to the conveying direction can be easily changed.

In the various line groups, other nozzles that are adjacent to both sides in the direction orthogonal to the conveying direction are disposed either on the upstream side or on the downstream side in the conveying direction. According to this, since nozzles are disposed in a zigzag pattern in the direction orthogonal to the conveying direction in each of all the kinds of line groups, ink before drying adhering to a recording medium can be kept from being mixed. Accordingly, ink droplets ejected from nozzles that are adjacent to each other in the direction orthogonal to the conveying direction can be kept from being mixed on a recording medium.

The plurality of common ink chambers extend in the direction orthogonal to the conveying direction, and are disposed so as to be spaced apart from each other by every distance that is an integral multiple of a distance that is obtained by multiplying a unit distance, corresponding to a highest resolution of the "n" resolutions, by $2^{n-1}$, and the nozzle sets belonging to the nozzle set groups are disposed in the vicinity of the corresponding common ink chambers as seen from the direction orthogonal to the ink ejection surface. According to this, the degree of integration of individual ink channels can be enhanced.

Two of the nozzle sets belonging to the nozzle set groups are disposed on both sides of a corresponding common ink chamber as seen from the direction orthogonal to the ink ejection surface. According to this, the capacity of the common ink chambers can be secured.

Three or more nozzle sets belong to the nozzle set groups, and the spaced distance between the nozzle sets that are adjacent to each other as seen from the direction orthogonal to the ink ejection surface becomes the greatest between the nozzle sets disposed on both sides of the corresponding common ink chamber becomes the greatest. According to this, the capacity of the common ink chambers can be secured while the degree of integration of the individual ink channels can be enhanced.

What is claimed is:

1. An ink-jet recording apparatus comprising:

a conveying unit configured to convey a recording medium;

an ink jet head including an ink ejection surface having a plurality of nozzles formed thereon configured to eject ink to the recording medium conveyed by the conveying unit in a first direction;

a storage unit configured to store a plurality of first resolutions with respect to the first direction of an image to be formed on the recording medium, a number of the first resolutions defined as n ($n \geqq 2$);

a resolution designation unit configured to designate one of the first resolutions stored in the storage unit; and a head control unit configured to control driving of the ink-jet head according to the designated first resolution, wherein the plurality of nozzles are arranged on the ink ejection surface in a matrix in the first direction and in a second direction orthogonal to the first direction, wherein the plurality of nozzles are grouped into a plurality of nozzle sets, each of the plurality of nozzle sets including nozzles arranged along the second direction, and wherein the plurality of nozzle sets are spaced from one another in the first direction by first distances, each of the first distances is an integral multiple of a distance that is obtained by multiplying a unit distance by $2^{n-1}$, the unit distance corresponding to a highest resolution among the first resolutions stored in the storage unit.

2. The ink-jet recording apparatus according to claim 1, wherein the plurality of nozzle sets are grouped into a plurality of nozzle set groups that include a same number of nozzles, and wherein the nozzle set groups, to which the nozzles disposed in order in the second direction belong, are repeated in a predetermined pattern.

3. The ink-jet recording apparatus according to claim 2, further comprising a plurality of common ink chambers that communicate with the nozzle set groups, which are different from one another, respectively.

4. The ink-jet recording apparatus according to claim 3, wherein the storage unit also is configured to store a plurality of second resolutions with respect to the second direction of the image to be formed on the recording medium, a number of the second resolutions defined as m ($m \geqq 1$), wherein the nozzle set groups are grouped into a plurality of line groups, to which adjacent $2^k$ ($0 \leqq k \leqq m-1$) nozzle set groups aligned in order from one side in the first direction are allocated, the line groups categorized into a plurality kinds of the line groups, the kinds of line groups respectively corresponding to numbers of k, wherein, each of the kinds of line groups for values of k, other than the kind of line groups when k=0, includes a plurality of sub line groups that are line groups for values of k−1, a nozzle belonging to one of sub line groups is disposed at a center position between two nozzles belonging to another sub line group adjacent to the one sub line group in the first direction, the two nozzles being adjacent each other in the second direction.

5. The ink-jet recording apparatus according to claim 4, wherein, in each of the line groups, two nozzles adjacent to one nozzle on both sides thereof with respect to the second direction are disposed either on an upstream side or on a downstream side of the one nozzle with respect to the first direction.

6. The ink-jet recording apparatus according to claim 3, wherein the plurality of common ink chambers extend in the second direction, and are spaced from one another in the first direction by every distance that is an integral multiple of a distance that is obtained by multiplying the unit distance by $2^{n-1}$ and wherein the nozzle sets belonging to the nozzle set groups are disposed in the vicinity of the respective common ink chambers when viewed from a direction orthogonal to the ink ejection surface.

7. The ink-jet recording apparatus according to claim 6, wherein two of the nozzle sets belonging to the nozzle set groups are disposed on both sides of the respective common ink chamber when viewed from the direction orthogonal to the ink ejection surface.

8. The ink-jet recording apparatus according to claim 7, wherein each of the nozzle set groups includes three or more nozzle sets, and wherein the distance between the nozzle sets disposed on both sides of the respective common ink chamber is a maximum distance among the distances between the adjacent nozzle sets when viewed from the direction orthogonal to the ink ejection surface.

9. The ink-jet recording apparatus according to claim 3, wherein each of the common chambers is arranged in a center of the respective nozzle set group with respect to the first direction.

10. The ink-jet recording apparatus according to claim 9, wherein the nozzle sets in each of the nozzle set groups are symmetrically arranged with respect to the respective common chamber in the first direction.

11. The ink-jet recording apparatus according to claim 1, wherein the plurality of nozzle sets are grouped into a plurality of nozzle set groups that include a same number of nozzles, and the nozzles in the nozzle set groups are arranged in a same arrangement pattern, and wherein the plurality of nozzle set groups are arranged along the first direction, and all the nozzles belonging to each of the nozzle set groups are arranged at equal intervals with respect to the second direction.

12. The ink-jet recording apparatus according to claim 11, further comprising a plurality of common ink chambers that communicate with the nozzle set groups, which are different from one another, respectively.

13. The ink-jet recording apparatus according to claim 12, wherein the storage unit also is configured to store a plurality of second resolutions with respect to the second direction of the image to be formed on the recording medium, a number of the second resolutions defined as m ($m \geqq 1$), wherein the nozzle set groups are grouped into a plurality of line groups, to which adjacent $2^k$ ($0 \leqq k \leqq m-1$) nozzle set groups aligned in order from one side in the first direction are allocated, the line groups categorized into a plurality kinds of the line groups, the kinds of line groups respectively corresponding to numbers of k, wherein, each of the kinds of line groups for values of k, other than the kind of line groups when k=0, includes a plurality of sub line groups that are line groups for values of k−1, a nozzle belonging to one of sub line groups is disposed at a center position between two nozzles belonging to another sub line group adjacent to the one sub line group in the first direction, the two nozzles being adjacent each other in the second direction.

14. The ink-jet recording apparatus according to claim 13, wherein, in each of the line groups, two nozzles adjacent to one nozzle on both sides thereof with respect to the second direction are disposed either on an upstream side or on a downstream side of the one nozzle with respect to the first direction.

15. The ink-jet recording apparatus according to claim 12, wherein the plurality of common ink chambers extend in the second direction, and are spaced from one another in the first direction by every distance that is an integral multiple of a distance that is obtained by multiplying the unit distance by $2^{n-1}$, and wherein the nozzle sets belonging to the nozzle set groups are disposed in the vicinity of the respective common ink chambers when viewed from a direction orthogonal to the ink ejection surface.

16. The ink-jet recording apparatus according to claim 15, wherein two of the nozzle sets belonging to the nozzle set groups are disposed on both sides of the respective common ink chamber when viewed from the direction orthogonal to the ink ejection surface.

17. The ink-jet recording apparatus according to claim 16, wherein each of the nozzle set groups includes three or more nozzle sets, and wherein the distance between the nozzle sets disposed on both sides of the respective common ink chamber is a maximum distance among the distances between the adjacent nozzle sets when viewed from the direction orthogonal to the ink ejection surface.

18. The ink-jet recording apparatus according to claim 13, wherein nozzles in each of the line groups are arranged at equal intervals with respect to the second direction.

19. The ink-jet recording apparatus according to claim 12, wherein each of the common chambers is arranged in a center of the respective nozzle set group with respect to the first direction.

20. The ink-jet recording apparatus according to claim 19, wherein the nozzle sets in each of the nozzle set groups are symmetrically arranged with respect to the respective common chamber in the first direction.

21. The ink-jet recording apparatus according to claim 1, wherein the conveying unit is configured to convey the medium at one of a first speed and a second speed which is twice as fast as the first speed.

22. The ink jet recording apparatus according to claim 1, wherein the plurality of first resolutions includes a resolution which is half of the highest resolution.

* * * * *